US010802517B1

(12) United States Patent
Assaad et al.

(10) Patent No.: US 10,802,517 B1
(45) Date of Patent: Oct. 13, 2020

(54) MULTI-MODE VOLTAGE REGULATOR

(71) Applicant: Texas Instruments Incorporated, Dallas, TX (US)

(72) Inventors: Rida Shawky Assaad, Murphy, TX (US); Angelo William Pereira, Allen, TX (US); Terry Lee Mayhugh, Jr., Richardson, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 16/455,056

(22) Filed: Jun. 27, 2019

(51) Int. Cl.
*G05F 1/46* (2006.01)
*G05F 1/56* (2006.01)

(52) U.S. Cl.
CPC ..... *G05F 1/461* (2013.01); *G05F 1/56* (2013.01)

(58) Field of Classification Search
CPC ... G05F 1/56; G05F 1/565; G05F 1/46; G05F 1/461
See application file for complete search history.

(56) References Cited

U.S. PATENT DOCUMENTS

2004/0113599 A1* 6/2004 Kojima ..... G05F 1/575 323/284
2012/0235655 A1* 9/2012 Ramirez ..... G05F 1/595 323/282

* cited by examiner

*Primary Examiner* — Gary L Laxton
(74) *Attorney, Agent, or Firm* — Michael A. Davis, Jr.; Charles A. Brill; Frank D. Cimino

(57) ABSTRACT

A voltage regulator circuit includes a bias circuit having an input and an output. The input of the bias circuit is coupled to an input voltage supply rail. A Zener diode has a cathode coupled to the output of the bias circuit. A resistor network is coupled to the output of the bias circuit. The resistor network includes a first circuit path, which includes a first resistor, connected in parallel with the Zener diode and a second circuit path, which includes a second resistor, coupled between the output of the bias circuit and a node. A current control circuit is coupled to the bias circuit and the resistor network. An output stage has an input and an output. The input of the output stage is coupled to the node.

18 Claims, 9 Drawing Sheets

MULTI-MODE VOLTAGE REGULATOR

BACKGROUND

Various types of voltage regulators have been developed for use in a wide range of applications. As an example, inexpensive voltage regulators have been designed using Zener diodes. The input supply voltage needs to be higher than the Zener voltage to keep the Zener diode in reverse breakdown and perform the desired regulation function. The Zener voltage tends to vary over process corners and temperature and may further exhibit poor performance under varying load conditions. In order to increase the power supply rejection and output voltage regulation, a bandgap reference may be used instead of a Zener diode. However, the use of a bandgap reference tends to significantly increase the cost of an otherwise inexpensive power supply.

SUMMARY

In one example, a voltage regulator circuit includes a bias circuit having an input and an output. The input of the bias circuit is coupled to an input voltage supply rail. A Zener diode has a cathode coupled to the output of the bias circuit. A resistor network is coupled to the output of the bias circuit. The resistor network includes a first circuit path, which includes a first resistor, connected in parallel with the Zener diode and a second circuit path, which includes a second resistor, coupled between the output of the bias circuit and a node. A current control circuit is coupled to the bias circuit and the resistor network. An output stage has an input and an output. The input of the output stage is coupled to the node.

In another example, a voltage regulator device includes a bias circuit configured to generate a bias based on a supply voltage at an input voltage rail. A Zener diode is configured to provide a Zener voltage based on the bias. A current control circuit includes a resistor network. The current control circuit is configured to provide a first current through a first path of the resistor network based on the Zener voltage and is configured to provide a node voltage at a node based on the Zener voltage and a second current through a second path of the resistor network. The second current is set by the current control circuit based on the first current and the Zener voltage relative to the supply voltage. An output stage is configured to provide a regulated output voltage at an output based on the node voltage.

In yet another example, a system includes a battery configured to provide a battery voltage. A bias circuit is configured to generate a bias based on a supply voltage at an input voltage rail. The supply voltage is set based on the battery voltage. A Zener diode is configured to provide a Zener voltage based on the bias. A current control circuit includes a resistor network. The current control circuit is configured to provide a first current through a first path of the resistor network based on the Zener voltage and is configured to provide a node voltage at a node based on the Zener voltage and a second current through a second path of the resistor network. The second current is set by the current control circuit based on the first current and the Zener voltage relative to the supply voltage. An output stage is configured to provide a regulated output voltage at an output based on the node voltage, wherein a ratio of a resistance of the first path and a resistance of the second path is configured to set the regulated output voltage to a fractional part of a Zener breakdown voltage of the Zener diode. A load may be coupled to the output of the output stage to operate based on the regulated output voltage.

DETAILED DESCRIPTION

Figure 1:
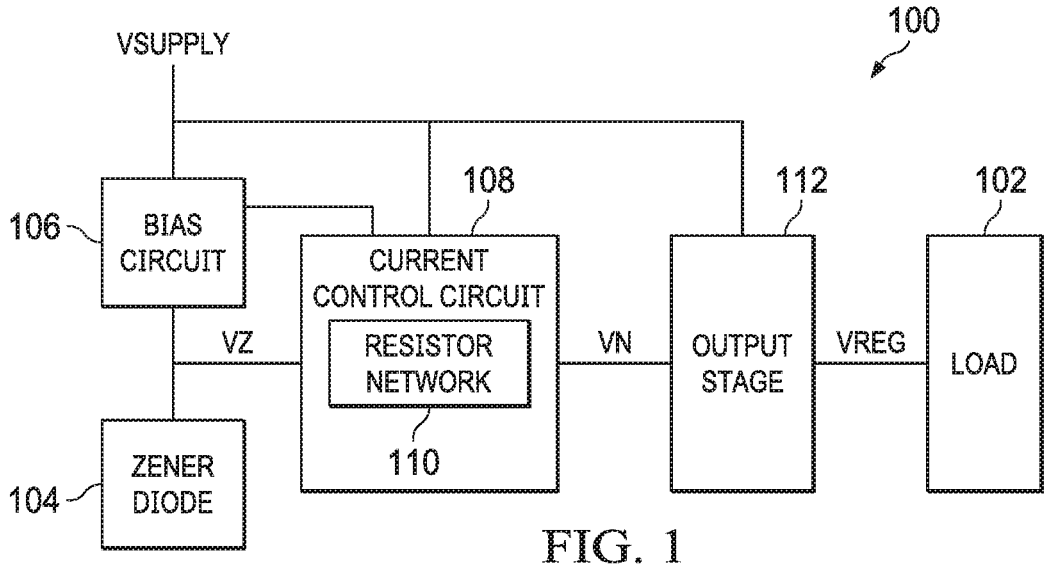
FIG. 1 illustrates a block diagram of an example of a multi-mode regulator system.

This disclosure relates to a voltage regulator that exhibits improved performance across temperature, supply voltage and process variations compared to a typical Zener regulator. For example, a typical Zener regulator includes a voltage divider and a Zener diode, a source follower and an output capacitor configured to provide a regulated voltage that is proportional to the voltage across the Zener diode. Such a configuration tends to exhibit poor performance over temperature and process variations unless a bandgap reference is utilized to provide the reference voltage. However, the use of bandgap reference increases the overall area of the circuit on an IC chip, which results in a corresponding increase in cost. Such cost increases are often cost prohibitive in many applications, such as local interconnect network (LIN) and Control Area Network (CAN) transceivers, several of which may be located on an Electronic Control Unit (ECU). For example, a typical automobile could contain 100-200 ECUs. The use of a band gap reference may also be unacceptable in a functional safety automotive or industrial application where the avoidance of common cause failure dictates that the monitoring circuits and the regulator circuits not share references, blocks or signals. In this latter scenario, it may be necessary to power up the monitoring circuit domain (i.e., the domain which includes the monitoring circuits) with a reference and regulator that are not related to the main circuit domain (i.e., the domain that includes the primary regulators that convey power to external loads).

As disclosed herein, a voltage regulator includes a Zener diode that provides a Zener voltage (VZ) when reverse biased into breakdown. The regulator is configured to scale the Zener voltage based on resistors in a resistor network that are connected to the Zener diode. For example, a first resistor is configured to set a current based on VZ, which is mirrored to a path that includes a second resistor. The second resistor is configured to set a node voltage (VN) that supplies a reference voltage to an output stage. The output stage is configured to provide a regulated output voltage (VREG) based on VN. For example, the fraction of the VZ voltage being used for generating VN and, in turn, VREG varies based on the supply voltage magnitude. The approach disclosed herein provides a Zener-based voltage regulator that exhibits low dropout and can be fabricated without including a bandgap reference. Thus, the regulator disclosed herein can be implemented on a smaller area of an integrated circuit (IC) chip and thus at a lower cost compared to bandgap-based regulators.

In some examples, the Zener-based voltage regulator further is configured to implement both regulation and input tracking modes. In the regulation mode, the regulator forces VREG to match a fixed internal reference voltage VN that is generated from the Zener voltage VZ while in reverse breakdown. In the tracking mode, the regulator continues to match the output voltage VREG to VN, but VN is equal to the Zener voltage VZ while the Zener diode is not in breakdown and VZ is equal to an input supply voltage. For example, the Zener-based regulator includes an arrangement of current mirrors configured to steer current through the regulator circuit and, in response to the input supply voltage being below the Zener voltage (VZ), transition the regulator circuit to the input tracking mode. By entering the tracking mode, such as in response to a decreasing input supply voltage, the regulator is configured to provide VREG that tracks the supply voltage with low dropout to enable continued operation of associated load circuitry and systems at least temporarily. For example, many applications (e.g., in automobiles and other industrial systems) may impose functional safety or other design requirements that require regulated power during shut down or cold start applications, including when the available input supply is below a threshold level, and the Zener-based regulator circuit, as disclosed herein, can support such requirements. Additionally, in each of its operating modes, the regulator can mimic a low dropout (LDO) regulator by maintaining the output voltage even when the supply voltage is close to the output voltage.

As used herein, the term "circuit" can include a collection of active and/or passive elements that perform a circuit function, such as an analog circuit or digital circuit. Additionally or alternatively, for example, the term "circuit" can include an integrated circuit (IC) where all or some of the circuit elements are fabricated on a common substrate (e.g., semiconductor substrate, such as a die or chip) or within a multi-chip module (e.g., within a single package). For example, a Zener-based voltage regulator, as disclosed herein, may be implemented on a respective IC chip.

Additionally, the term "couple" is used throughout the specification. The term may cover connections, communications, or signal paths that enable a functional relationship consistent with the description of the present disclosure. For example, if device A generates a signal to control device B to perform an action, in a first example device A is coupled to device B, or in a second example device A is coupled to device B through intervening component C if intervening component C does not substantially alter the functional relationship between device A and device B such that device B is controlled by device A via the control signal generated by device A.

FIG. 1 is a block diagram of an example regulator system 100 configured to provide a regulated voltage (VREG) to a load 102. The system 100 includes a Zener diode 104 that is coupled to a voltage supply rail (VSUPPLY) through a bias circuit 106, which is coupled to VSUPPLY and the Zener diode 104. For example, the voltage supply VSUPPLY is provided from a direct-current (DC) source, such as including one or more DC batteries. Thus, in some examples, the voltage of VSUPPLY may vary, such as decreasing over time during operation. As one example, the battery voltage may discharge over time with use. In other examples, VSUPPLY may undergo large voltage transients over a brief period of time, such as seen in automotive applications in the event of a cold or warm crank or in other applications when a reset due to some fault is applied to a system connected to the battery. In the example of automotive applications, the battery voltage may experience a fall from a nominal voltage (e.g., about 12-14V) to a much lower voltage (e.g., as low as 2-3V in cold crank and as low as 3-4V in warm crank). A cold crank scenario occurs when a car is started the first time. A warm crank may occur when an automobile's ignition is turned off, such as at a traffic stop light and ignition is initiated again when the automobile is activated to move again.

The bias circuit 106 is configured to bias the Zener diode 104 and a current control circuit 108 based on VSUPPLY. The Zener diode 104 is configured to provide a Zener voltage (VZ) across the Zener diode based on the biasing. For example, in a normal operating mode, the bias circuit 106 is configured to reverse-biases the Zener diode 104 above its breakdown voltage such that the Zener voltage VZ is at or approximates its Zener breakdown voltage. The Zener diode 104 may be fabricated to have a desired Zener breakdown voltage VZ during reverse breakdown, and a Zener diode can be selected for the system 100 with a breakdown voltage according to application requirements. For example, the Zener breakdown voltage may be in a range from about 5V to about 20V; though, it may be less than 5V or greater than 20V. The Zener voltage VZ provides a reference voltage to the current control circuit 108 based on the biasing implemented by the bias circuit, which further may depend on the voltage of VSUPPLY. As described herein, the current control circuit 108 may be configured to steer current adaptively based on the input supply voltage VSUPPLY, which determines the fraction of the VZ voltage being used for generating the output VREG.

The current control circuit 108 includes a resistor network 110. The current control circuit 108 is coupled to an input of an output stage 112 to provide a node voltage (VN) based on the Zener voltage VZ. As an example, the current control circuit 108 includes an arrangement of current mirrors configured to provide a first current through a first path of the resistor network 110 based on the Zener voltage VZ. In this example, it may be presumed that the Zener voltage VZ is at or approximates its Zener breakdown voltage. The current control circuit 108 is further configured to steer a second current through a second path of the resistor network to provide the node voltage VN based on the first current and the biasing of the bias circuit. For example, the value of the resistance of the first path sets the second current for the second path, and the value of the resistance of the second path sets the node voltage VN based on the VZ. In an example, the current control circuit is further configured to provide the second current equal to the first current. In other examples, different proportional relationships may exist between the first current and the second current.

As a further example, the value of the node voltage VN can be set according to resistance values in the resistor network 110 and the breakdown voltage of the Zener diode. For a given Zener diode a ratio of the resistances of the first and second paths of the resistor network 110 determines the node voltage VN, which sets the regulated output voltage VREG. The resistor network 110 thus is programmable to set the regulated output voltage VREG to a desired fractional part of the Zener breakdown voltage VZ according to the ratio of resistors in the resistor network. The resistors in the resistor network 110 may be designed and implemented (e.g., hardwired) in an integrated circuit (IC) or be programmed from variable resistors (e.g., through fuses or laser trimming). Thus, the resistors and/or the Zener diode define variable parameters that may be configured according to application requirements to set the regulated output voltage VREG.

The output stage 112 is configured to provide the regulated output voltage VREG at an output thereof based on the node voltage VN. The output stage 112 may be configured differently according to the type of load 102 that is connected to the output of the output stage and operating requirements of the system. In one example, the output stage includes a field effect transistor (FET) (e.g., an n-type metal oxide semiconductor FET (NMOSFET)) configured as source follower coupled between the voltage supply rail VSUPPLY and the output. In this configuration, a clamp circuit may be coupled to a gate of the FET and to the node providing VN. The clamp circuit is configured to set a voltage of the gate of the field effect transistor above the node voltage VN by an amount approximating a gate-to-source voltage of the field effect transistor. In this way, the regulator system 100 can simulate a low dropout (LDO) regulator by setting the regulated output voltage VREG to closely track a desired (e.g., nominal) value of VN over a wide range of the SUPPLY VOLTAGE as well as across temperature and process variations.

In another example configuration, the output stage 112 is implemented as a regulation loop that includes an output transistor device (e.g., a P-type MOSFET) coupled between the output and the supply rail. The regulation loop includes circuitry configured to regulate a gate of the output transistor based on the node voltage and the regulated output voltage (e.g., fed back from the output), such that VREG tracks the voltage VN, which further may exhibit with lower dropout over a wide range of the voltage supply rail VSUPPLY as well as across temperature and process variations.

In some examples of the regulator system 100, the current control circuit 108 is configured to operate in multiple modes, including a regulation mode and a tracking mode, which depend on the voltage at the input voltage rail VSUPPLY. The current control circuit 108 is configured to operate in the regulation mode in response to the bias circuit 106 biasing the Zener diode 104 in reverse breakdown, such as in response to VSUPPLY exceeding the reverse-breakdown voltage of the Zener diode. In the regulation mode, the current control circuit 108 is configured to keep the node voltage VN fixed (e.g., a fractional part of VZ), which results in a corresponding VREG being provided to the load 102. The current control circuit 108 operates in the tracking mode when the supply voltage trends below a preset value. In some examples, the transition from regulation to tracking mode is designed to be gradual so as not to disturb the circuits supplied by the regulator. In practice, one may consider the transition to commence when the VSUPPLY is close to the normal breakdown voltage of the Zener diode.

In the tracking mode, the current control circuit 108 is configured to provide the node voltage VN as a variable voltage that tracks the supply voltage VSUPPLY, such that VREG also tracks the supply voltage. For example, the tracking mode enables the system 100 to continue to provide VREG to the load with low dropout to afford time for load systems to perform shutdown functions even after the supply voltage has decreased below a desired value for VREG. During cold start operations, before the supply voltage VZ increases to at least the reverse-breakdown voltage of the Zener diode 104, the current control circuit 108 may also operate in the tracking mode to enable wake up and low power operation of associated circuitry in the load 102.

Figure 6:
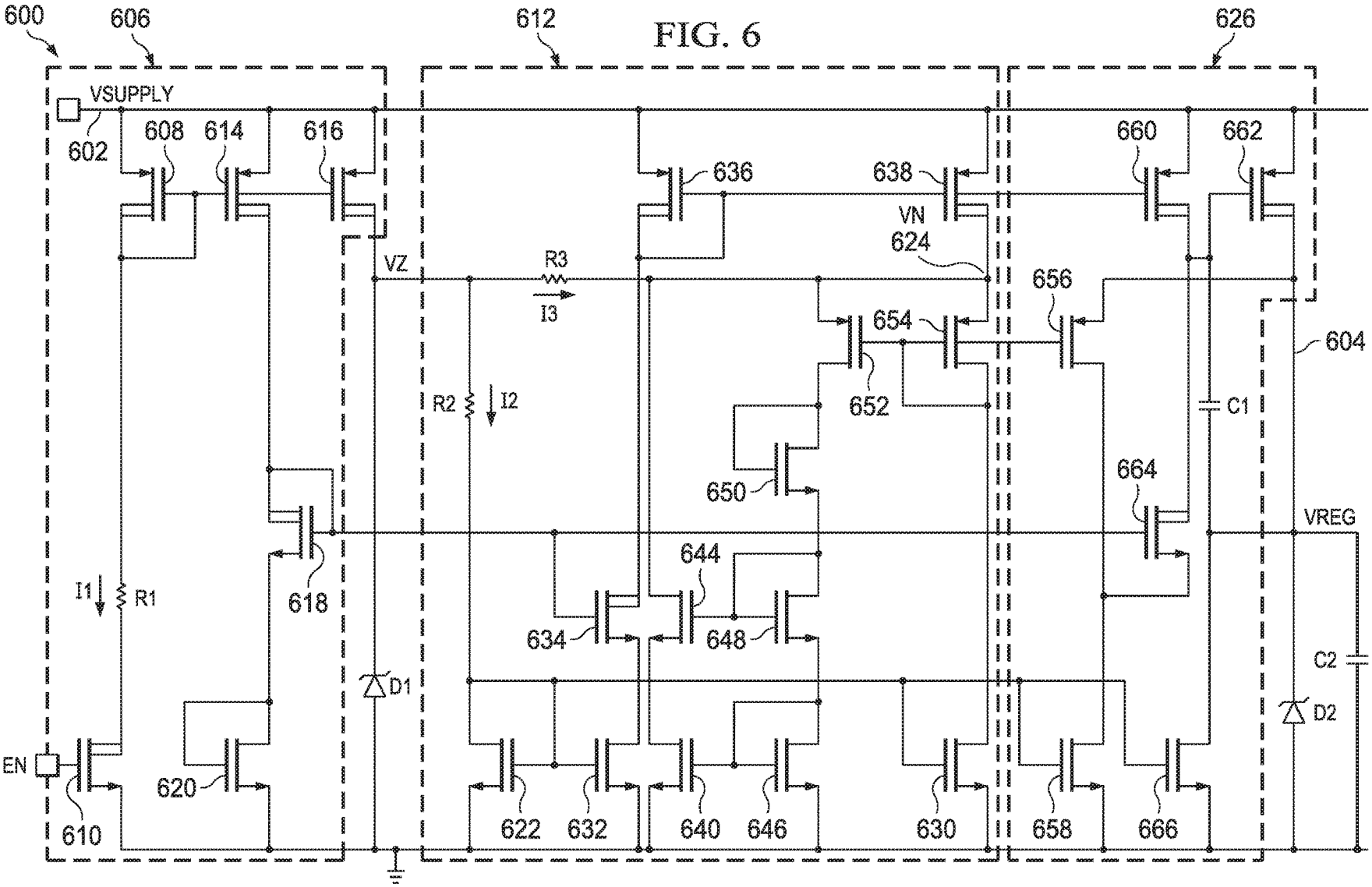
FIG. 6 illustrates another example of a multi-mode regulator circuit.
Figure 7:
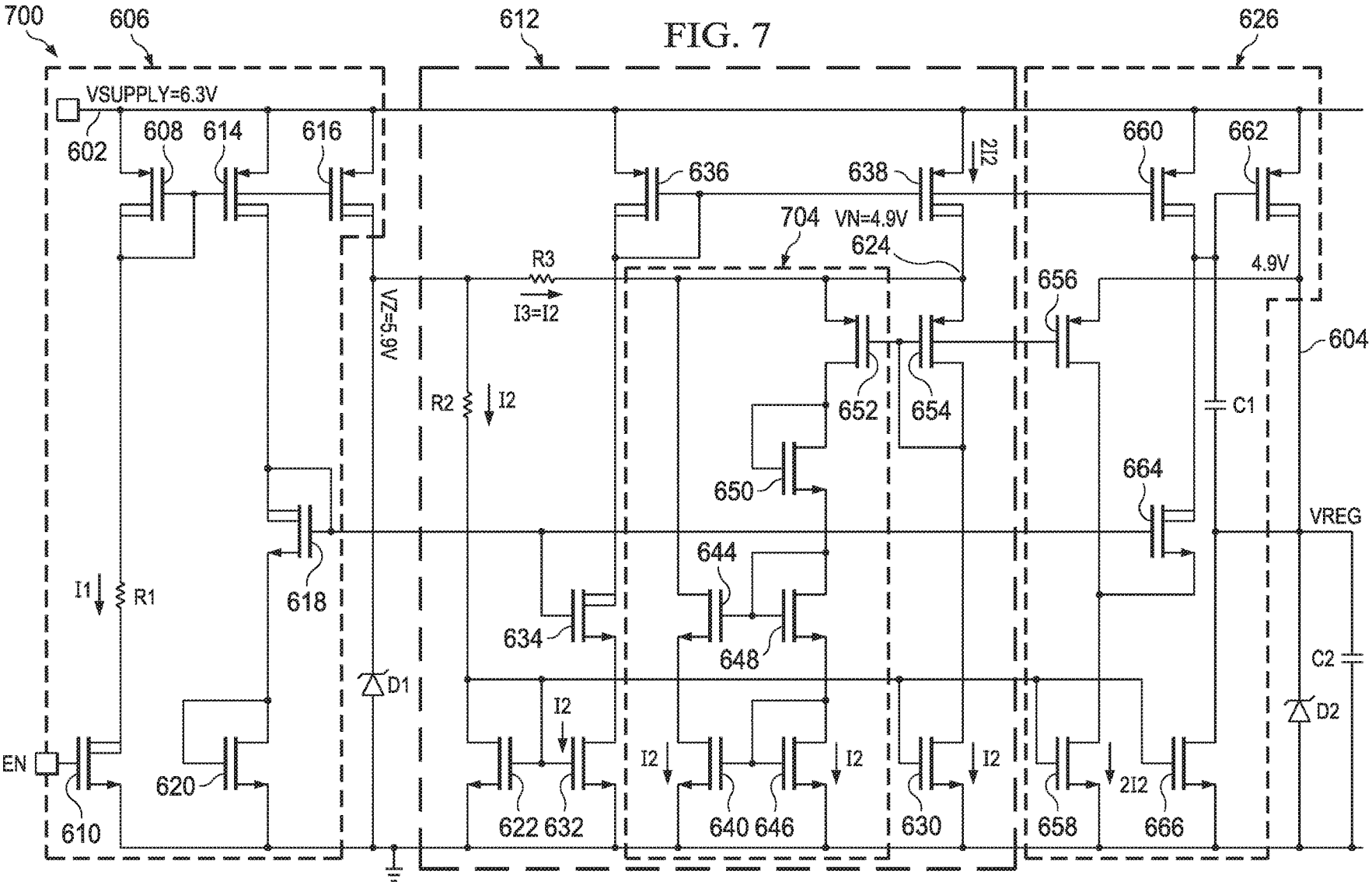
FIG. 7 illustrates the regulator circuit of FIG. 6 operating in an example regulation mode.
Figure 8:
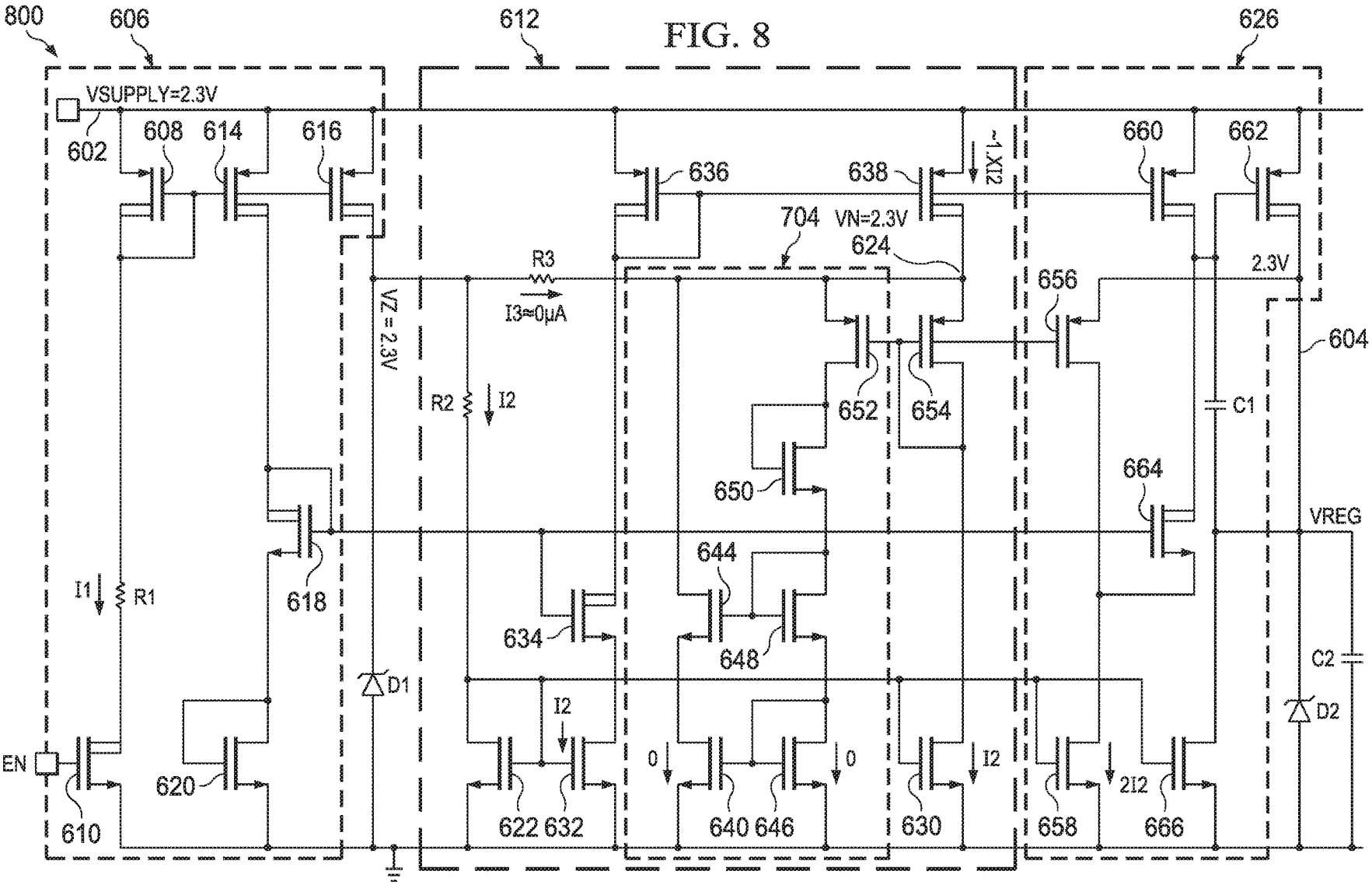
FIG. 8 illustrates the regulator circuit of FIG. 6 operating in an example tracking mode

The current control circuit 108 thus is further configured to transition between the regulation mode and the tracking mode based on the Zener voltage VZ and the supply voltage VSUPPLY. For example, the current control circuit 108 includes a mode detector (e.g., including a cascode current mirror, such as shown in FIGS. 6-8) that is configured to mirror current through the circuit provided that adequate headroom voltage exists to keep transistor devices in saturation. In response to the Zener voltage falling below the supply voltage, such that sufficient headroom voltage no longer exists, the Zener diode is no longer in reverse-breakdown and the Zener voltage VZ is set equal to (or approximates) the supply voltage VSUPPLY. Because the VZ is below the breakdown voltage, the headroom voltage likewise is reduced such that the mode detector is unable to steer sufficient current through the circuit 108 (e.g., due to transistor devices being not saturated), such that the node voltage VN is equal to (or approximates) VZ. In this mode of operation, the output stage 112 may remain configured to regulate the output voltage VREG but to the variable VN. For example, a regulation loop of the output stage 112 is configured to regulate a gate of the output transistor based on VN and the regulated output voltage, such that the regulated output voltage VREG tracks VN, which corresponds to the supply voltage VSUPPLY.

In view of the foregoing, the system 100 allows a regulation voltage to be increased when compared to a low-cost Zener regulator. The current steering implemented by the current control circuit 108 and resistor network 110 further achieves a low dropout voltage, which allows a lower supply voltage VSUPPLY to achieve the same regulated output voltage VREG compared to many existing low-cost Zener regulators. The performance of the regulator system 100 is further comparable to bandgap regulators across temperature and process variations, but can achieve such performance with a significant reduction in on-die area (e.g., an improved die area of about 2.5 times or more), resulting in a lower cost circuit. The regulator system 100 further can implement mode transitions based on the VSUPPLY without additional circuitry as well as support warm and cold start operations, as may be useful in some applications.

Figure 2:
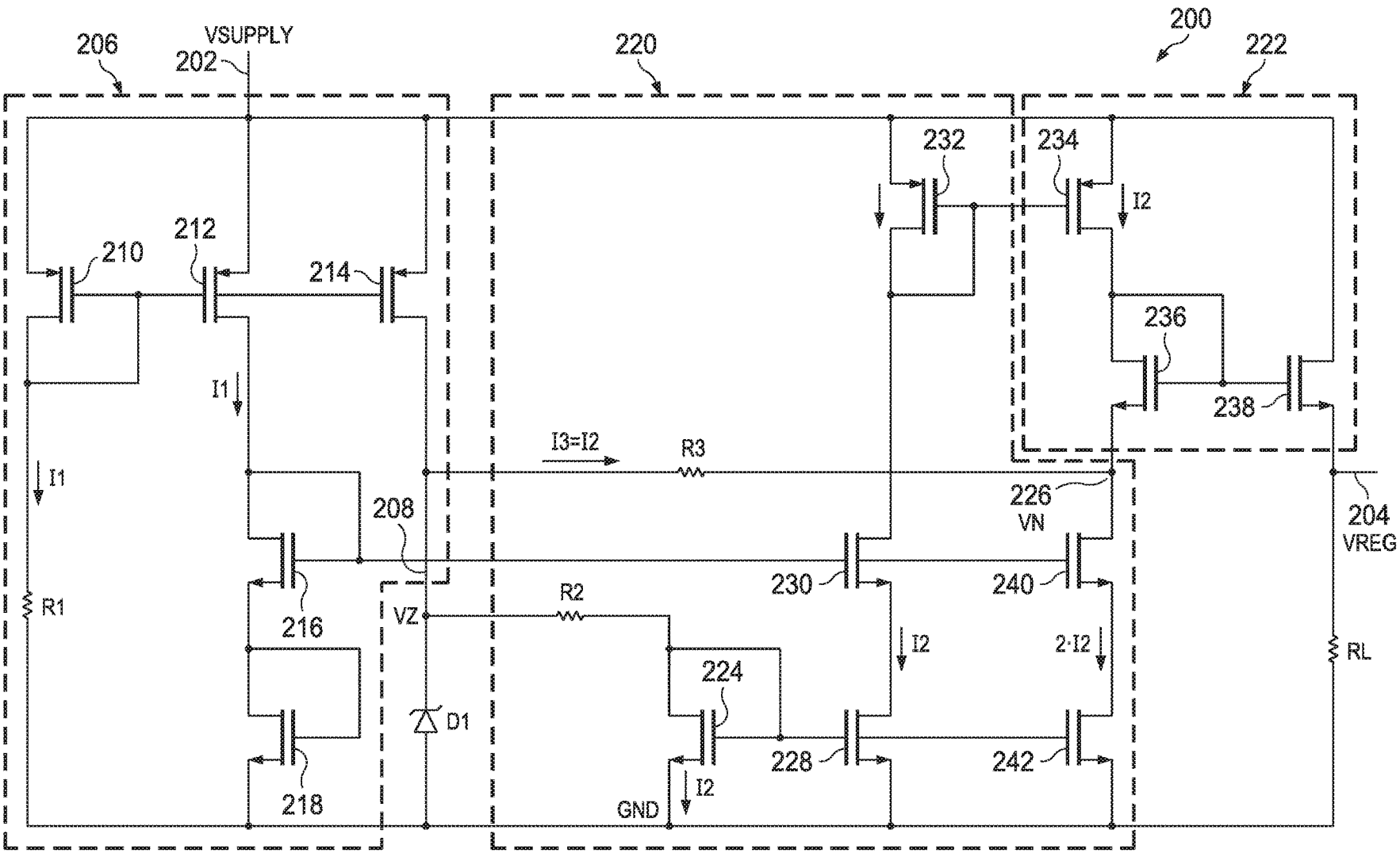
FIG. 2 illustrates an example of a regulator circuit.

FIG. 2 depicts an example of a regulator circuit 200 (e.g., corresponding to the system 100). The circuit 200 includes an input 202 coupled to a supply voltage (VSUPPLY). The VSUPPLY provides an input rail to supply voltage to the circuit 200. The circuit 200 is configured to provide a regulated output voltage VREG at an output 204 of the circuit. The circuit 200 includes a bias circuit 206 (e.g., corresponding to bias circuit 106) that is coupled to the input 202 to receive VSUPPLY. The bias circuit 206 includes an output 208 that is coupled to cathode of a Zener diode D1 (e.g., corresponding to Zener diode 104). The Zener diode D1 is coupled between the output 208 and a neutral voltage, such as electrical ground of the circuit 200.

In the example of FIG. 2, the bias circuit 206 includes a current source, such as diode-connected transistor device 210 in series with a resister R1 between the input 202 and electrical ground. The current source thus provides a current I1 through the resistor R1 according to VSUPPLY. The bias circuit 206 also includes a current mirror that includes transistors 212 and 214. For example, the current I1 can provide a reference current that is mirrored through transistor 212 to forward bias diode connected transistor devices 216 and 218. The transistor 214 may be configured as part of a current mirror to multiply the current I1 to provide a corresponding current to bias the Zener diode D1 into a reverse breakdown state. The bias current supplied from the transistor can be proportional to I1 according to a ratio of the mirror formed of transistor devices 210 and 214. As an example, the transistor device 214 can be sized with respect to device 210 to increase current I1 by a factor of 20.

In response to the biasing from the bias circuit 206, the Zener diode operates in reverse breakdown to provide a Zener voltage at its cathode, demonstrated at VZ. The Zener voltage VZ is provided to a current control circuit 220 (e.g., corresponding to current control circuit 108). The current control circuit 220 is configured to steer current based on the Zener voltage VZ and provide a node voltage (VN) at a node. The node voltage VN is supplied to an output stage 222 (e.g., corresponding to output stage 112) for generating the regulated voltage VREG.

The current control circuit 220 includes a resistor network of resistors R2 and R3 (e.g., corresponding to resistor network 110). A first path of the resistor network includes resistor R2 and a transistor device 224 connected between the cathode of the diode D1 and electrical ground. The voltage VZ across the resistor R2 and diode-connected transistor device 224 thus establishes a current I2 (where I2=VZ−VGS_224)/R2) through the first path of the resistor network, where VGS_224 is the gate-to-source voltage of transistor device 224. Because VZ remains constant during breakdown over a wide range of current, the current I2 can be set based on the resistance of R2, which can be a design parameter for the circuit 200. The current control circuit 220 steers a current I3 along a second path of the resistor network that includes resistor R3 connected between the cathode of diode D1 and the node 226. For example, the current control circuit 220 is configured to set the current I3 through the resistor R3 based on I2. Thus, as mentioned, the current I2 is set based on the Zener voltage VZ of the diode D1 and the value of resistor R2. The node voltage VN is set based on the current I3 (which may be set equal to current I2) and the value of the resistor R3, such that VN=VZ−(I3*R3).

In one example, the current control circuit 220 includes an arrangement of current mirrors connected between the supply rail VSUPPLY and electrical ground configured to set I3=I2. For example, the current I2 is replicated from diode-connected transistor device 224 through a current mirror that includes transistor device 228, which is configured to pull current equal to I2 through transistor device 230 and diode-connected transistor device 232. The current through device 232 is, in turn, mirrored to transistor device 234 of the output stage 222 which is sourced to diode-connected transistor device 236, which has a common gate with an output transistor device 238. Thus, the current through transistor device 234 biases diode-connected transistor device 236 and is provided to node 226 where it is added to current I3 to provide corresponding combined current through a series of transistor devices 240 and 242 connected between the node 226 and electrical ground. For example, the transistor device 242 is configured to provide twice current I2 (2*I2) in the path between the node 226 and ground based on the current I2 that is mirrored from transistor device 224 through transistor device 242. In this way, by configuring the circuit 220 to set the current through devices 240 and 242 equal to 2*I2 and the current through devices 234 and 236 equal to I2 results in the current I3 being equal to I2. Therefore, because VZ remains constant during breakdown over a wide range of current, the voltage at VN can be set based on the resistance of R3, which can be another design parameter for the circuit 200 to set VN. That is, for a Zener diode D1 having a known breakdown voltage VZ, the ratio of R2 and R3 thus can be configured and designed to set the node voltage VN, VN=VZ*(1−R3/R2)+VGS_224*(R3/R2) to a desired voltage at the node 226.

The output transistor device 238 is configured as a source follower having its gate connected to the drain of transistor device 236. Accordingly, the gate voltage of the output transistor device 238 is increased above the node voltage VN by the gate to source drop across transistor device 236 such that the regulated output voltage VREG is approximately equal to a node voltage VN. By setting the gate voltage of the output transistor device in this way, the regulated output voltage VREG can closely match the node voltage VN across process and temperature variations. In this example, a load demonstrated as resistor RL is connected between the regulator output 204 and ground. For example, the resistor RL may correspond to a voltage monitor circuit, a transceiver or a variety of other circuitry that may require a regulated output voltage.

As disclosed herein, VREG tracks VN in stable manner over a range of temperature and process variations. It can thus be shown that for the example of FIG. 2:

VREG=VZ−I3*R3+ΔVGS_222, where ΔVGS_222 is the gate-to-source voltage difference between transistor device 236 and output transistor device 238 of the output stage 222, and $$I3 = I2 = \frac{VZ - \text{VGS_224}}{R2},$$

where VGS_224 is the gate-to-source voltage of transistor device 224 of the current control circuit 220.

When transistor devices 236 and 238 are sized to operate with a small over-drive voltage, or similar current densities, across the load range of interest, ΔVGS_222 is minimized, and it can be shown that the regulated output voltage VREG can be determined as follows:

$$VREG = VZ*\left(1 - \frac{R3}{R2}\right) + \frac{R3}{R2}*\text{VGS_224}.$$

Thus, and assuming by way of example, that R2=70 R and R3=13 R, where R is a unit resistor, VZ=5.9V and VGS=1V, results in VREG=5.0V.

Variation in the regulated output voltage VREG over temperature can be expressed as follows:

$$\frac{\partial VREG}{\partial T} = \frac{\partial VZ}{\partial T}*\left(1 - \frac{R3}{R2}\right) + \frac{R3}{R2}*\frac{\partial \text{VGS_224}}{\partial T},$$

where $$\frac{\partial VZ}{\partial T}$$

and $$\frac{\partial VGS_224}{\partial T}$$

are temperature coefficients of the Zener voltage and the gate-to-source voltage of transistor device 224 (as VREG is a rational function of R2 and R3 and they are assumed to be of the same material with equal temperature coefficients, they do not contribute to VREG temperature variations). Both $$\frac{\partial VZ}{\partial T}$$

and $$\frac{\partial VGS_CC}{\partial T}$$

have a direct impact on VREG variations over temperature and are defined by the fabrication process used to implement the circuit, having typical absolute values in the range of approximately 1-2 mV/° C., with $$\frac{\partial VZ}{\partial T}$$

being positive for VZ>5V while $$\frac{\partial VGS_224}{\partial T}$$

always being negative. However, with proper biasing and scaling of R2 and R3, a $$\frac{\partial VREG}{\partial T}$$

on the order of approximately ±0.1 mV/° C. is achievable to provide for a high level of VREG stability over temperature. Similar stability over process variations can be demonstrated for the node voltage with respect to the unit resistance R as well as for variation in VREG with respect to VN.

Figure 3:
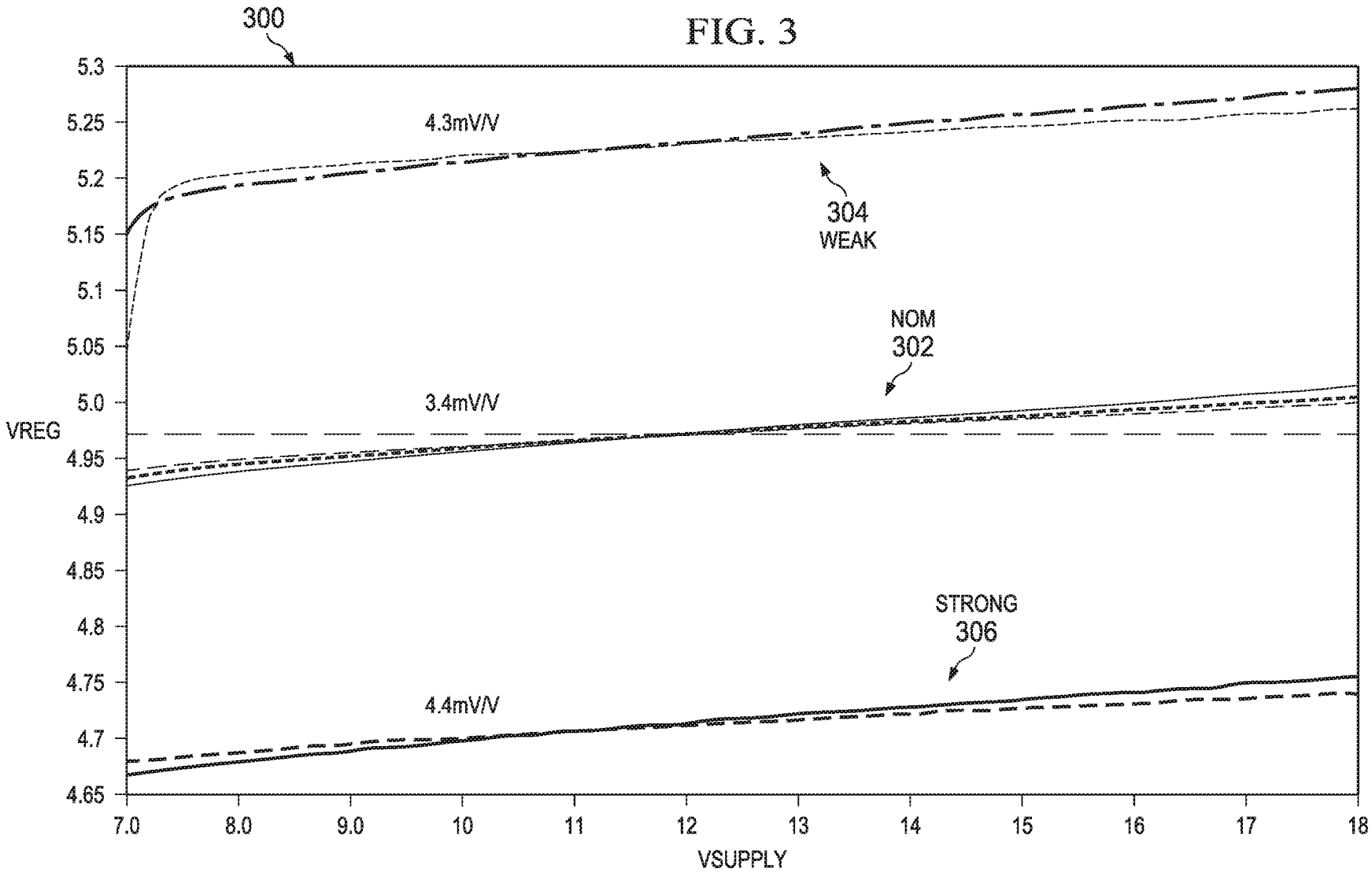
FIG. 3 is a plot demonstrating examples of a regulated voltage produced by the circuit of FIG. 2 as a function of a supply voltage showing variation across temperature and process conditions.

FIG. 3 is a plot 300 demonstrating examples of a regulated voltage VREG (e.g., provided at 204) as a function of supply voltage VSUPPLY (e.g., provided at 202) for the example circuit 200 of FIG. 2. In this example, VREG is plotted for different process conditions (nominal, strong and weak process corners) and over temperature ranging from about −40° C. to about 125° C. For nominal process conditions, VREG, demonstrated at 302, exhibits approximately 3.4 mV/V variation across a supply voltage ranging from 7 volts to 18 volts and over temperature from about −40° C. to about 125° C. Under weak process conditions, the regulated voltage VREG, demonstrated at 304, exhibits about 4 mV/V over the range of supply voltages. Additionally, under weak process conditions the regulated voltage ranges from about 5.05V to 5.28V, with the majority of the spread occurring near a supply voltage of approximately 7 V, as transistor device 234 of FIG. 2 leaves the saturation operation region. Under strong process conditions, the regulated voltage VREG, demonstrated at 306, varies about 4.4 mV/V over the range of supply voltages.

Figure 4:
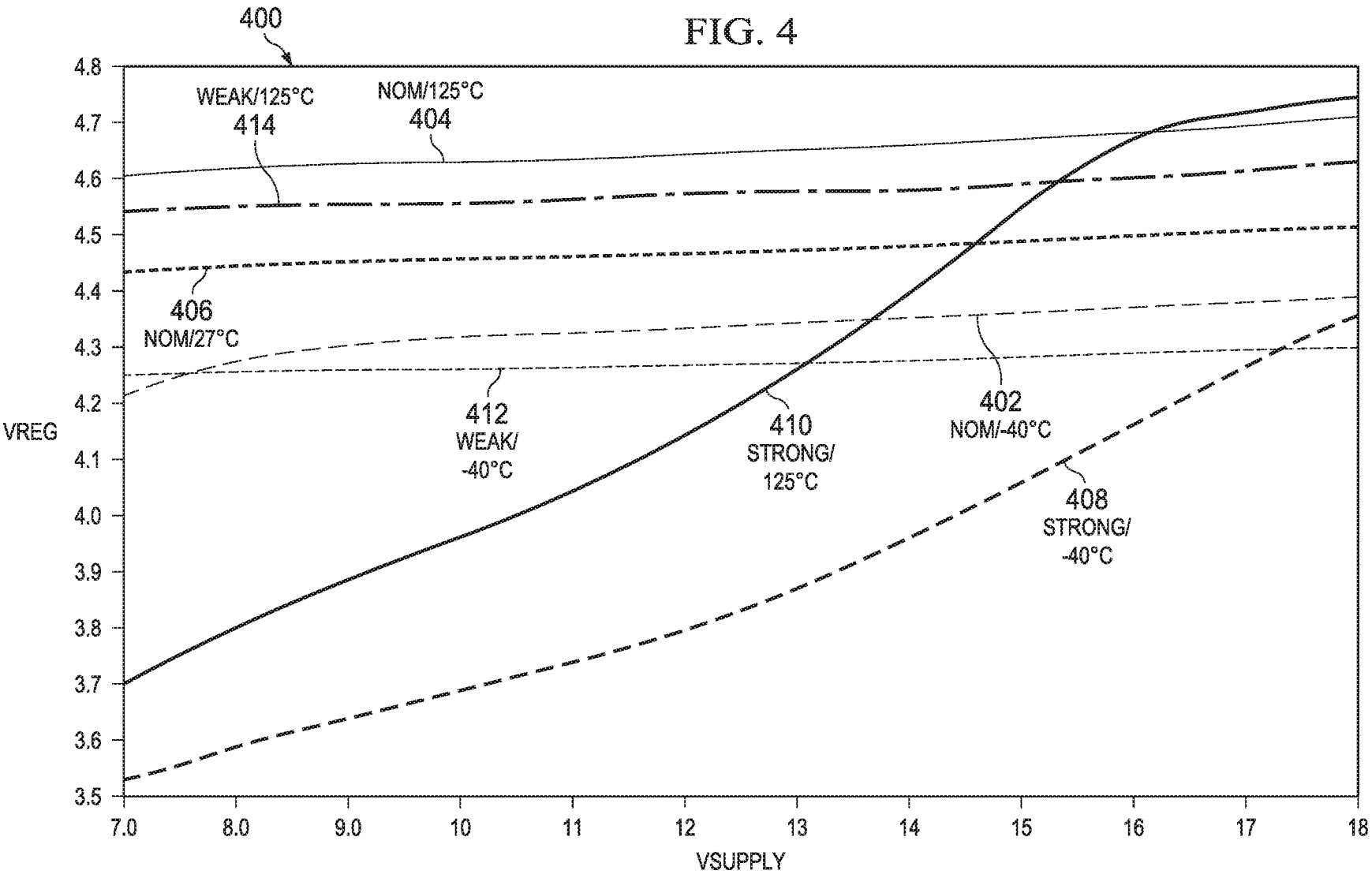
FIG. 4 is a plot demonstrating examples of a regulated voltage produced by another regulator circuit as a function of a supply voltage showing increased variation across temperature and process conditions.

FIG. 4 demonstrates an example plot 400 showing regulated voltage VREG as a function of supply voltage VSUPPLY across process and temperature variations, similar to FIG. 3, but for an existing Zener diode voltage regulator in an open-loop configuration without the current control circuit 220 in the circuit of FIG. 2. In contrast to the plot 300 in FIG. 3, the regulated voltage in the plot 400 exhibits increased variation across both process and temperature corners. For example, under nominal process conditions at −40° C. a plot 402 ranges from about 4.2 volts to about 4.4 volts. Under similar nominal process conditions the open-loop Zener based regulator at 125° C. is shown at 404 ranging from about 4.6 to about 4.7 volts. There is significant voltage separation between the plots 402, 404 and 406, and their counterparts in FIG. 3 grouped as 302, indicating a considerably larger voltage variation over temperature.

Plots 408 and 410 demonstrate the regulated voltage at strong process conditions and at temperature of −40° C. and 125° C., respectively. The plots 408 and 410 thus demonstrate that for strong process conditions, the regulated voltage VREG varies significantly across supply voltage. FIG. 4 also demonstrates plots 412 and 414 for weak process conditions and temperature of −40° C. and 125° C., respectively. Plots 412 and 414 thus demonstrate that over temperature there is significant variation in VREG for an existing type of Zener voltage regulator even under weak process variation. Thus, a comparison between FIGS. 3 and 4 demonstrates that the circuit of FIG. 2 exhibits improved performance across a wide range of process and temperature conditions compared to an existing Zener voltage regulator in an open loop configuration.

Figure 5:
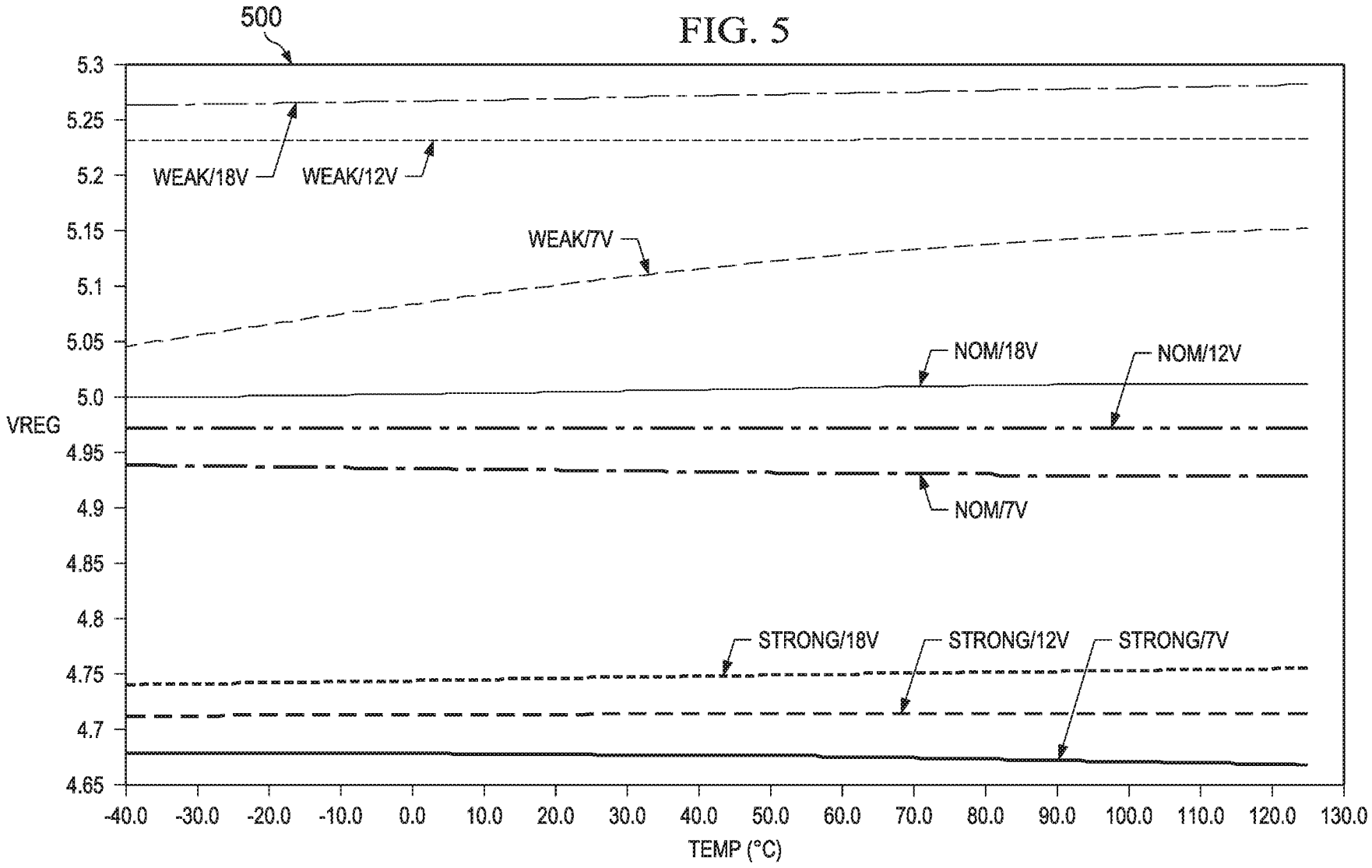
FIG. 5 is a plot demonstrating examples of a regulated voltage produced by the circuit of FIG. 2 as a function of temperature for different supply voltages and process conditions.

As a further example, FIG. 5 demonstrates a plot 500 of regulated voltage VREG as a function of temperature that can be generated by the circuit 200 for different supply voltages and process conditions. As shown, the regulated voltage VREG exhibits flatness with respect to temperature showing less variation compared to the existing Zener regulator design demonstrated in FIG. 4.

FIG. 6 depicts another example of a regulator circuit 600. The circuit 600 includes an input supply rail 602 connected to receive an input supply voltage demonstrated at VSUPPLY. The regulator circuit 600 is configured to provide a regulated output voltage (VREG) at an output 604. The supply rail 602 thus provides a corresponding DC voltage to various parts of the circuit 600. The circuit 600 includes a bias circuit 606 (e.g., corresponding to bias circuit 106) that is configured to bias a Zener diode D1 (e.g., corresponding to Zener diode 104) and a current control circuit 612 (e.g., corresponding to current control circuit 108). For example, the bias circuit 606 is configured to bias the Zener diode D1 into reverse breakdown based on the supply voltage VSUPPLY to provide a corresponding Zener voltage VZ across the diode. The diode D1 is connected between an output of the bias circuit 606 and ground.

In the example of FIG. 6, the bias circuit 606 includes a current source formed of a diode-connected transistor device 608 that is connected in series with a resistor R1 between the input supply and electrical ground. In an example, another transistor device 610 can be activated in response to an enable signal (EN) to turn on and off the regulator circuit 600. Thus, in response to the enable signal EN activating transistor 610, the current source provides a reference current I1 through the resistor R1. The bias circuit 606 also includes current mirrors configured to mirror the current I1 for biasing the Zener diode D1 as well as circuitry in a current control circuit 612.

For example, the bias circuit 606 includes transistor devices 614 and 616 having a common gate with the transistor device 608 to mirror the current I1 based on the proportionality of the respective devices 608, 614 and 616. In an example, the transistor device 614 can mirror the current I1 through respective transistor devices 618 and 620 connected between the device 614 and ground. For example, transistor devices 618 and 620 are diode-connected. The transistor device 616 can be configured (based on its relative size compared to device 608) to provide an increased current to reverse bias the Zener diode D1. In response to reverse biasing the Zener diode D1, a corresponding Zener breakdown voltage VZ at the cathode of the diode is provided as an input to the current control circuit 612. The diode D1 thus can be configured to provide a desired VZ.

The current control circuit 612 includes a resister network (e.g., corresponding to resistor network 110) that includes resisters R2 and R3. The resistor R2 is part of the current path of the resistor network that includes resistor R2 and diode-connected transistor device 622 between the output of the bias circuit 606 and electrical ground. Thus, in response to the Zener voltage VZ, a corresponding current I2 is established through resistor R2 (e.g., I2=(VZ-VGS_622)/R2, where VGS_622 represents the gate-to-source voltage of transistor device 622.

The current control circuit 612 also includes current steering circuitry configured to provide a corresponding current I3 being provided through the resistor R3. For example, the current control circuit 612 can utilize the current steering circuitry to set the current I3 proportional to the current I2 (e.g., I3=I2). The current I3 across the resistor R3 thus results in a corresponding node voltage VN being provided at the node 624 (e.g., VN=VZ−(I3*R3)). The node voltage VN is provided at the node 624 as an input voltage to drive an output stage 626 (e.g., corresponding to output stage 112) based on the current I2 that is steered through the circuit 612 to establish I3.

As an example, the gate of transistor device 632 is connected to the gate of diode-connected transistor 622 to mirror the current I2 through the cascode NMOS transistor 634 and diode-connected PMOS transistor 636. The gate of transistor device 630 is also connected to diode-connected transistor 622 to mirror current I2 through the diode-connected PMOS transistor 654. The gate of another PMOS transistor device 638 is connected with the gate of PMOS transistor 636, though device 638 is sized to force an amount of current to the node 624 that is proportional to I2. For example, the transistor device 638 can be sized to source twice the current that is provided through the transistor device 636 in response to mirroring the current I2. In an example, the transistor device 638 is configured to source 2*I2 to the node VN.

Additionally, current can be sourced from the node 624 to the respective current paths that include diode-connected PMOS transistor 654 and NMOS transistor 630, PMOS transistor device 652 and NMOS diode-connected transistors 650, 648 and 646, and NMOS transistor devices 644 and 640. Diode-connected PMOS transistor 654 conducts a current I2 mirrored by NMOS transistor 630. The gate of PMOS transistor 652 is connected to diode connected PMOS transistor 654 and together they form a current mirror with reference to VN (node 624). In an example, PMOS transistor 652 is sized equal to PMOS transistor 654 and accordingly mirrors a current I2 through NMOS transistors 650, 648 and 646. Finally, NMOS transistor 640 mirrors a current I2 from diode-connected NMOS transistor 646 through cascode NMOS transistor 644 back to node 624.

As a further example, with transistor device 638 sourcing 2*I2 to node 624, and transistor devices 654, 652 and 644 collectively sourcing 3*I2 from node 624, a current equal to I2 is forced through R3, setting I3=I2 and node voltage VN=VZ−(I2*R3) at node 624. Thus, so long as the supply voltage remains greater than the Zener voltage, as disclosed herein, the circuit 612 provides a regulated (e.g., fixed) reference voltage VN at 624. The resistor network R2, R3 together with the Zener diode D1 thus provide design parameters that are each configurable to set the regulated reference voltage VN during the regulation mode. As described herein, the circuit 612 may also operate in a tracking mode in which VN tracks VSUPPLY.

The output stage 626 may include an amplifier circuit, such as configured as a closed loop unity gain feedback amplifier to provide the regulated output voltage VREG at output 604 based on the node voltage VN and the output voltage VREG (e.g., provided as feedback). By way of example, the output stage 626 includes transistor devices 654, 656, 658, 660, 662 and 664 configured as a current input amplifier to regulate the output at node 604 based on the node voltage VN and VREG that is provided to the source of PMOS device 656. The bias circuit 606 further can be configured to bias transistor device 664 which is connected between devices 660 and 658 forming the folding cascode part of the output amplifier. The feedback amplifier may require frequency compensation, which in this example is performed with a capacitor C1 connected to a node coupling the gate of transistor 662 with the drain of device 660 and VREG. Compensation may further require device 662 to conduct some minimum current provided here, by way of example, with another transistor device 666. The gate of the transistor device 666 may be coupled to the gate of transistor device 622 to bias transistor device 666 to source the minimum current needed from device 662 for proper compensation. Additionally, in some examples, another Zener diode D2 may be connected in parallel with capacitor C2 between the output 604 and ground such as to provide for clamping protection at the output voltage VREG.

As mentioned, the current control circuit 612 may be configured to operate the regulator circuit 600 in multiple regulation modes. For example, the circuit 600 may be configured to operate in a regulation mode in which the regulated output voltage VREG is set to a fixed DC voltage in response to the bias circuit 606 reverse biasing the Zener diode D1 in breakdown (e.g., when the supply voltage VSUPPLY is greater than the Zener breakdown voltage of D1). The circuit 600 may also operate in a tracking mode in response to the supply voltage VSUPPLY being less than the Zener voltage VZ. In the tracking mode, the node voltage VN is variable and approximates (or is equal to) the supply voltage VSUPPLY, and the output stage 626 in turn provides voltage VREG at 604 to track the node voltage VN such that VREG=VSUPPLY.

To demonstrate transitions between the regulation mode and tracking mode for the circuit 600, reference is to be made to FIGS. 7 and 8, which depict the circuit 600 in respective operating modes, shown at 700 and 800. In each of FIGS. 7 and 8, for ease of explanation, identical reference characters are used to refer to parts and signals introduced with respect to FIG. 6.

In FIG. 7, the circuit 700 is operating in the regulation mode for an example where the Zener diode D1 has a breakdown voltage of 5.9 volts and the supply voltage VSUPPLY is at about 6.3V or greater. The current control circuit 612 includes a mode detector 704 configured to detect and control transitions between the regulation and tracking modes. In this example, the mode detector 704 includes a PMOS device 652 and a cascoded current mirror of diode-connected NMOS devices 646, 648 and 650. The mode detector also includes NMOS devices 640 and 644 connected between the node 624 and ground. The gates of NMOS devices 640 and 644 are connected with corresponding gates of NMOS devices 646 and 648 to form respective current mirrors in the mode detector 704. As shown in FIG. 7, the mode detector 704 is configured to sink current I2 (e.g., mirrored based on the current I2 through R2) from the node 624 through each current mirror path, for a total of 2*I2, provided that adequate headroom voltage exists to keep transistor devices in saturation.

With the supply voltage equal to or exceeding the Zener voltage VZ, each of the PMOS and NMOS transistor devices in the current control circuitry 612 operates in saturation. Thus, device 638 is sourcing 2*I2 to node 624 and devices 654, 652 and 644 are each sourcing I2 from node 624, forcing the remaining I2 current to be sourced from VZ to node 624 through R3 to achieve equilibrium. In this example, the current I2 is set to equal the Zener voltage minus a gate-to-source voltage drop across the transistor device 622 divided by R2, namely, I2=(VZ−VGS_622)/R2. The current I2 thus provides the reference current that the current control circuit 612 mirrors through the circuit, including current I3 through resistor R3, I3=I2, to generate the node voltage VN, as described with respect to FIG. 6, VN=VZ−I2*R3=VZ*(1−R3/R2)+VGS_622*(R3/R2). For example, for VZ=5.9V, R2=500KΩ, R3=100KΩ and VGS_622=1V, the resulting VN is 4.92V. As described herein, the output stage 626 is configured as a closed loop unity gain amplifier to regulate the output voltage VREG to a value of VN, namely to approximately 4.92V. The transistor devices in the output stage 626 are configured to operate in saturation in the regulation mode as well as in the tracking mode. However, transistor device 662 may leave the saturation region somewhere in the transition region between regulation and tracking modes.

FIG. 8 depicts an example of the Zener-based regulator circuit 800 operating in the tracking mode. In the tracking mode, the supply rail voltage VSUPPLY is substantially lower than the Zener breakdown voltage (e.g., VSUPPLY=2.3 V). Under such circumstances, the bias circuit 606 is unable to operate the Zener diode D1 in breakdown and the transistor device 616 is configured to operate in a triode region (instead of in saturation). For this example, where the Zener diode D1 is no longer in breakdown, VZ≈VSUPPLY=2.3V.

Because the VZ is below the breakdown voltage, the headroom voltage likewise is reduced such that mode detector 704 is unable to steer sufficient current through the current control circuit. In this example, because of the lower voltage at VSUPPLY (e.g., about 2.3V), the device stack comprised of 652, 650, 648 and 646 lacks the headroom voltage needed to operate properly and the PMOS device 652 operates in deep triode region sourcing negligible current, and the current through the mirror of NMOS devices 640 and 646 approaches zero. However, PMOS device 654 remains configured (in saturation) to sink current I2 from the node 624 because the mirror provided by NMOS device 630 has sufficient headroom even with the reduced VSUPPLY. Thus, unlike the example of VSUPPLY equal to 6.3V (or greater), where 3*I2 were sourced from node 624, here only a current of approximately I2 is sourced from node 624. It follows that the PMOS device 638 is driven to operate in its triode region to reduce its current from 2*I2 previously down to that of the PMOS device 654 any triode region current of PMOS device 652 and the corresponding mirror of NMOS devices 640 and 646. As a result, the current control circuit 612 likewise operates to reduce the current through R3 toward zero, such that VN=VZ, and, as mentioned VZ=VSUPPLY. The output stage 626 remains configured during this tracking mode to regulate VREG to the reduced VN (e.g., VREG≈VSUPPLY).

In view of the foregoing examples of FIGS. 6-8, the circuit 600 thus provides a Zener-based regulator circuit configured to scale the Zener reference voltage by a factor K which is set by resistor ratios R2 and R3. For example, the current control circuit 612 is configured to implement current mode control to regulate VREG=VZ*(1−K)+VGS_622*K, where K<1 and is set based on R3/R2. The current control circuit 612 further is configured to naturally transition from the regulation mode to the tracking mode when VSUPPLY falls below VZ (e.g., K→0). This configuration further utilizes an output stage to drive a load at VREG and create an area efficient design that can be implemented on an IC chip without requiring bandgap circuitry to achieve desired performance across temperature and process. The result is a cost efficient design that meets or exceeds performance criteria of many applications.

Figure 9:
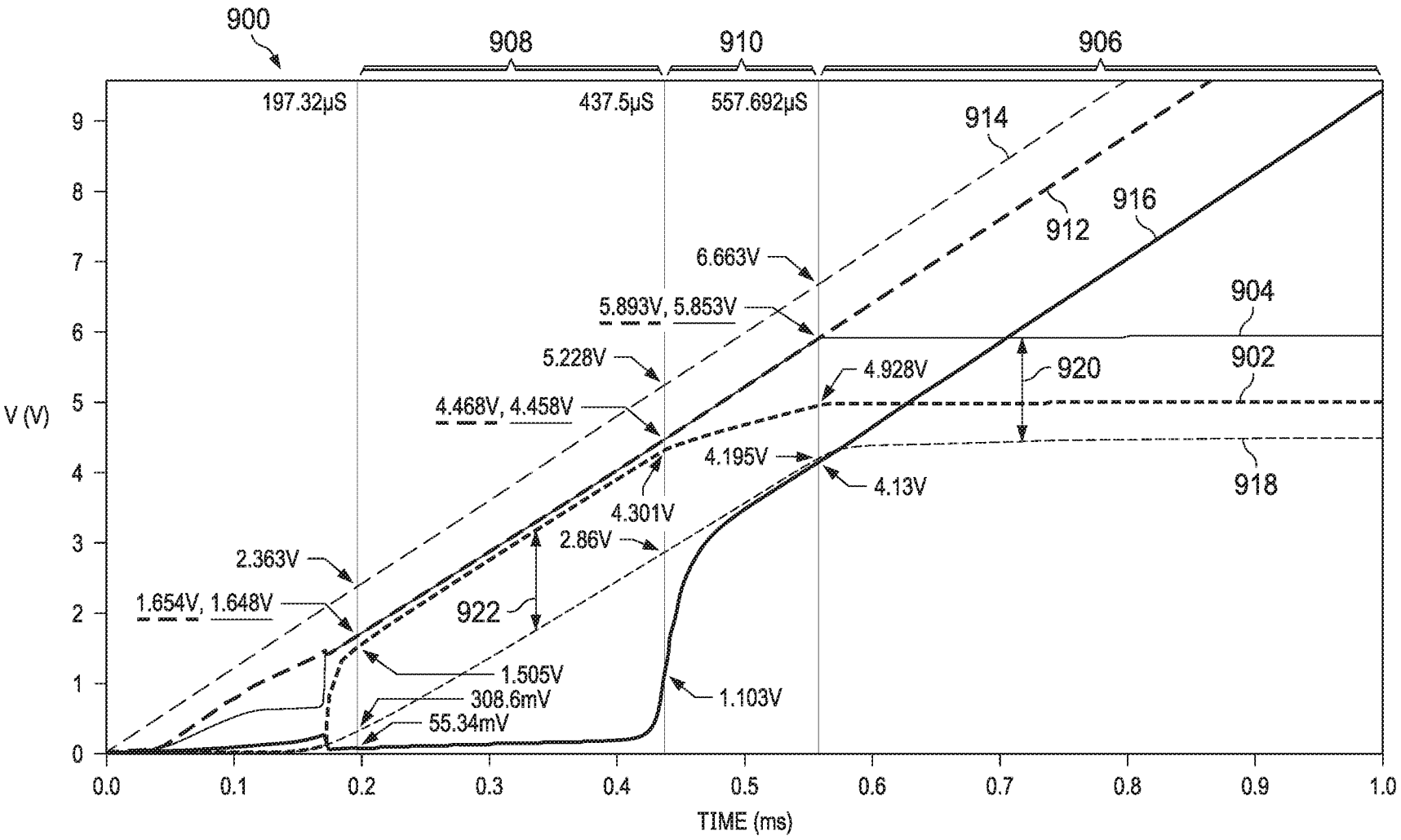
FIG. 9 is a plot demonstrating example waveforms from the circuit of FIG. 6 compared to another regulator circuit.

As a further example, FIG. 9 depicts a graph 900 of voltage waveforms in the regulator circuit 600, which demonstrates operating voltages over time to provide for multiple modes of operation, as disclosed herein. A regulated output voltage VREG (e.g., voltage at 604 for the circuit 600) is demonstrated at 902 together with cathode voltage of Zener diode D1 (VZ) at 904. The regulated output voltage 902 is shown for operation in a regulation mode, demonstrated at 906, and in a tracking mode, demonstrated at 908. A transition between the tracking and regulation modes 908 and 906, respectively, is demonstrated at 910. Also demonstrated in the graph 900 include the supply voltage 912 (e.g., corresponding to VSUPPLY at rail 602) and a battery voltage 914 that can be utilized to provide the supply voltage (e.g., through a power diode). Thus, the supply voltage 912 can be provided at a diode-drop below the battery voltage 914.

As shown in the regulation mode 906, the VREG 902 is at a fixed DC voltage (e.g., approximately 5V). As disclosed herein, the circuit 600 provides regulated output voltage to remain constant over process and temperature variations. As the supply voltage 912 of the supply rail 602 falls below the Zener breakdown voltage (e.g., approximately 5.9V), the circuit enters the transition mode, corresponding to region 910, in which VREG gradually transitions from the regulation mode 906 into the tracking mode 908 or from the tracking mode to the regulation mode. The mode transition occurs over range of the supply voltage 912, which corresponds to the PMOS device 652 switching from saturation to operation in the deep triode region. In the tracking mode, the circuit 600 provides VREG to track the supply voltage 912 down to approximately 1.5 V. FIG. 9 also shows a gate voltage 916 of output transistor device (e.g., PMOS device 662), which tracks the supply voltage during both the regulation mode 906 and the majority of transition 910 and then falls to 0V for the tracking mode.

As shown in FIG. 9, the transition of VREG 902 (in region 910 between regulation and tracking modes) is smooth. This is in contrast to a regulated output VREG that is produced by an existing Zener regulator design, as demonstrated at 918. The existing VREG 918 thus is provided below the Zener voltage, VZ 904, by a threshold level (e.g., a gate-to-source voltage), shown at 920. Additionally, instead of a smooth, gradual transition into tracking mode over a range of the supply voltage (as provided by the circuit 600 of FIG. 6), the existing regulator design immediately begins tracking the supply voltage 912 once the supply voltage drops below the Zener voltage (e.g., about 5.9 V) without any gradual transition into the tracking mode. Additionally, the existing design provides a larger dropout voltage during both regulation (at 920) and tracking (shown at 922). For example, during regulation 906, there is about 1.4V dropout (at 920) and during tracking, the existing design has approximately 1.7V dropout (at 922) between the supply voltage 912 and the tracking voltage 918. FIG. 9 thus demonstrates the low dropout capability of the regulator circuit 600 disclosed herein.

What have been described above are examples. It is, of course, not possible to describe every conceivable combination of components or methods, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. Additionally, where the disclosure or claims recite "a," "an," "a first," or "another" element, or the equivalent thereof, it should be interpreted to include one or more than one such element, neither requiring nor excluding two or more such elements.

What is claimed is:

1. A voltage regulator circuit comprising:

a voltage supply terminal;

a bias circuit having an input and an output, the input coupled to the voltage supply terminal;

a Zener diode having a cathode coupled to the output of the bias circuit;

a resistor network coupled to the output of the bias circuit, the resistor network including: a first circuit path, which includes a first resistor, connected in parallel with the Zener diode; and a second circuit path, which includes a second resistor;

a current control circuit coupled to the bias circuit and the resistor network; and an output stage having an input and an output, the second circuit path coupled between the output of the bias circuit and the input of the output stage;

wherein the Zener diode is configured to provide a Zener voltage based on biasing by the bias circuit;

the current control circuit is configured to provide: a first current through the first resistor based on the Zener voltage; a reference voltage at the input of the output stage based on the Zener voltage; and a second current through the second resistor, the second current based on the first current; and the output stage is configured to provide a regulated output voltage at the output of the output stage based on the reference voltage.

2. The circuit of claim 1, wherein the output stage comprises a unity gain amplifier configured to provide the regulated output to track the reference voltage.

3. The circuit of claim 2, wherein the unity gain amplifier comprises a field effect transistor configured as a source follower coupled between the voltage supply terminal and the output of the output stage, the circuit further comprising a clamp circuit coupled to the input of the output stage and to a gate of the field effect transistor, the clamp circuit configured to set a voltage of the gate of the field effect transistor above the reference voltage by an amount approximating a gate-to-source voltage of the field effect transistor.

4. The circuit of claim 1, wherein the current control circuit comprises a current mirror circuit configured to set the second current equal to the first current.

5. The circuit of claim 1, wherein the output stage comprises a regulation loop that includes an output transistor device coupled between the output of the output stage and the voltage supply terminal, the regulation loop configured to regulate a gate of the output transistor device based on the reference voltage and the regulated output voltage such that the regulated output voltage tracks the reference voltage.

6. A voltage regulator circuit comprising:

a voltage supply terminal;

a bias circuit having an input and an output, the input coupled to the voltage supply terminal;

a Zener diode having a cathode coupled to the output of the bias circuit;

a resistor network coupled to the output of the bias circuit, the resistor network including: a first circuit path, which includes a first resistor, connected in parallel with the Zener diode; and a second circuit path, which includes a second resistor;

a current control circuit coupled to the bias circuit and the resistor network; and an output stage having an input and an output, the second circuit path coupled between the output of the bias circuit and the input of the output stage;

wherein a ratio of the first resistor and the second resistor is configured to set a regulated output voltage at the output of the output stage to a fractional part of a Zener breakdown voltage of the Zener diode.

7. A voltage regulator circuit comprising:

a voltage supply terminal;

a bias circuit having an input and an output, the input coupled to the voltage supply terminal;

a Zener diode having a cathode coupled to the output of the bias circuit;

a resistor network coupled to the output of the bias circuit, the resistor network including: a first circuit path, which includes a first resistor, connected in parallel with the Zener diode; and a second circuit path, which includes a second resistor;

a current control circuit coupled to the bias circuit and the resistor network; and an output stage having an input and an output, the second circuit path coupled between the output of the bias circuit and the input of the output stage;

wherein the Zener diode is configured to provide a Zener voltage based on biasing by the bias circuit according to a supply voltage at the voltage supply terminal;

the current control circuit is configured to provide a first current through the first resistor based on the Zener voltage; and the output stage is configured to provide a regulated output voltage at the output of the output stage based on a reference voltage at the input of the output stage.

8. The circuit of claim 7, wherein the current control circuit is configured to operate in a regulation mode responsive to the supply voltage exceeding a Zener breakdown voltage of the Zener diode, in which the Zener diode is configured to operate in a reverse breakdown state and provide the Zener voltage corresponding to the Zener breakdown voltage based on biasing by the bias circuit, and the current control circuit is configured to provide: the first current through the first resistor based on the Zener breakdown voltage; the reference voltage based on the Zener breakdown voltage; and a second current through the second resistor, in which the second current is set by the current control circuit based on the first current.

9. The circuit of claim 8, wherein the current control circuit is configured to operate in a tracking mode responsive to the supply voltage being less than the Zener breakdown voltage of the Zener diode, in which the reference voltage tracks the supply voltage.

10. The circuit of claim 9, wherein the current control circuit comprises:

cascoded diode-connected transistors coupled between the input of the output stage and a ground terminal; and a current mirror configured in the regulation mode to bias the cascoded diode-connected transistors in saturation to conduct current based on the first current and configured in the tracking mode to operate the cascoded diode-connected transistors in a triode region such that current through the second resistor approximates zero, and the reference voltage equals the Zener voltage, which tracks the supply voltage.

11. The circuit of claim 9, wherein the current control circuit is configured to transition between the regulation mode and the tracking mode based on a difference between the Zener voltage and the supply voltage relative to a threshold voltage.

12. A voltage regulator device comprising:

a voltage terminal;

a bias circuit configured to generate a bias based on a supply voltage at the voltage terminal;

a Zener diode configured to provide a Zener voltage based on the bias;

a current control circuit including a resistor network, the current control circuit configured to provide: a first current through a first path of the resistor network based on the Zener voltage; a reference voltage at an output of the current control circuit based on the Zener voltage; and a second current through a second path of the resistor network, in which the second current is set by the current control circuit based on the first current and the Zener voltage relative to the supply voltage; and an output stage configured to provide a regulated output voltage at an output of the output stage based on the reference voltage;

wherein the current control circuit is configured to operate in a regulation mode responsive to the supply voltage exceeding a Zener breakdown voltage of the Zener diode, in which the Zener diode is configured to operate in reverse breakdown such that the Zener voltage is provided at the Zener breakdown voltage; and the first path of the resistor network includes a first resistor, the second path of the resistor network includes a second resistor, and a ratio of the first resistor and the second resistor is configured to set the regulated output voltage to a fractional part of the Zener breakdown voltage.

13. The device of claim 12, wherein the first current flows through the first path according to the Zener voltage and a resistance of the first resistor, the reference voltage corresponds to a difference between the Zener breakdown voltage and a voltage drop across the second resistor based on the second current, and the current control circuit comprises a current mirror circuit configured to set the second current proportional to the first current.

14. The device of claim 12, wherein the current control circuit is configured to operate in a tracking mode responsive to the supply voltage being less than the Zener breakdown voltage of the Zener diode, in which the current control circuit is configured to control current to provide a variable reference voltage at the output of the current control circuit that is equal to the Zener voltage, which is also variable and less that the Zener breakdown voltage.

15. The device of claim 14, wherein the current control circuit comprises:

a mode detector including cascoded diode-connected transistors coupled between the output of the current control circuit and a ground terminal; and a current mirror configured in the regulation mode to bias the cascoded diode-connected transistors in saturation to conduct current based on the first current and configured in the tracking mode to operate the cascoded diode-connected transistors in a triode region such that current through the second resistor is zero to set the reference voltage equal to the Zener voltage, which tracks the supply voltage.

16. The device of claim 14, wherein the current control circuit is configured to transition between the regulation mode and the tracking mode based on a difference between the Zener voltage and the supply voltage relative to a threshold voltage.

17. A voltage regulator device comprising:

a voltage terminal;

a bias circuit configured to generate a bias based on a supply voltage at the voltage terminal;

a Zener diode configured to provide a Zener voltage based on the bias;

a current control circuit including a resistor network, the current control circuit configured to provide: a first current through a first path of the resistor network based on the Zener voltage; a reference voltage at an output of the current control circuit based on the Zener voltage; and a second current through a second path of the resistor network, in which the second current is set by the current control circuit based on the first current and the Zener voltage relative to the supply voltage; and an output stage configured to provide a regulated output voltage at an output of the output stage based on the reference voltage;

wherein the output stage comprises a regulation loop that includes an output transistor device coupled between the output of the output stage and the voltage terminal, the regulation loop configured to regulate a gate of the output transistor device based on the reference voltage and the regulated output voltage such that the regulated output voltage tracks the reference voltage.

18. A system comprising:

a battery configured to provide a battery voltage;

a voltage terminal;

a bias circuit configured to generate a bias based on a supply voltage at the voltage terminal, in which the supply voltage is set based on the battery voltage;

a Zener diode configured to provide a Zener voltage based on the bias;

a current control circuit including a resistor network, the current control circuit configured to provide: a first current through a first path of the resistor network based on the Zener voltage; a reference voltage at an output of the current control circuit based on the Zener voltage; and a second current through a second path of the resistor network, in which the second current is set by the current control circuit based on the first current and the Zener voltage relative to the supply voltage;

an output stage configured to provide a regulated output voltage at an output of the output stage based on the reference voltage, wherein a ratio of a resistance of the first path and a resistance of the second path is configured to set the regulated output voltage to a fractional part of a Zener breakdown voltage of the Zener diode; and a load coupled to the output of the output stage to operate based on the regulated output voltage;

wherein the current control circuit is configured to operate in a regulation mode responsive to the supply voltage exceeding the Zener breakdown voltage of the Zener diode, in which the Zener diode is configured to operate in reverse breakdown such that the Zener voltage is provided at the Zener breakdown voltage; and the current control circuit is configured to operate in a tracking mode responsive to the supply voltage being less than the Zener breakdown voltage of the Zener diode, in which the current control circuit is configured to reduce the second current to provide a variable reference voltage at the output of the current control circuit that is equal to the Zener voltage, which approximates the supply voltage.

* * * * *